United States Patent [19]

Zawacki et al.

[11] 4,208,900

[45] Jun. 24, 1980

[54] AXLE SPINDLE FORMING APPARATUS

[75] Inventors: Joseph H. Zawacki, Detroit; John P. Dutton, Dearborn Heights, both of Mich.

[73] Assignee: Lear Siegler, Inc., Detroit, Mich.

[21] Appl. No.: 883,776

[22] Filed: Mar. 6, 1978

Related U.S. Application Data

[62] Division of Ser. No. 773,456, Mar. 2, 1977, Pat. No. 4,100,781.

[51] Int. Cl.[2] ..... B21D 22/00

[52] U.S. Cl. ..... 72/354; 72/356; 72/359; 72/370; 72/474

[58] Field of Search ..... 72/353, 354, 356, 359, 72/370, 474

[56] References Cited

U.S. PATENT DOCUMENTS

| | | | |
|---|---|---|---|
| 303,173 | 8/1884 | Mark | 72/474 |
| 981,697 | 1/1911 | Simpson | 72/356 |
| 2,256,065 | 9/1941 | Urschel | 72/370 X |
| 2,344,803 | 3/1944 | Criley | 72/356 X |
| 2,368,695 | 2/1945 | Wilber | 72/356 |

*Primary Examiner*—Leon Gilden

*Attorney, Agent, or Firm*—Reising, Ethington, Barnard, Perry & Brooks

[57] ABSTRACT

Apparatus and a method disclosed for forming an axle spindle from a hollow axle blank incorporate a hollow punch having a metallic body with an inner work surface defining a work opening and a mandrel fixed within the work opening projecting toward an open end thereof from a closed end of the opening. During forming, the punch is moved relative to the axle blank in the direction the mandrel projects so that the mandrel is received within the hollow axle blank as the work surface of the punch body forms the blank about the mandrel to provide a spindle. Preferably, several punches of this type are utilized to complete the spindle forming process on the axle blank. Each punch preferably has an elongated annular shape with a round inner work surface and a round outer surface on the mandrel so that the formed spindle is of a round shape. One of the punches which causes outward material movement has an undercut on its mandrel to facilitate punch withdrawal. The forming is best performed by a hot forging operation on a heated axle blank end and the hollow punch body has a sufficient length so it extends past the heated portion of the blank end before deformation begins. A pair of cooperable gripper dies include gripping portions for locating the axle blank during the forging and define an elongated opening with a round cross section for slidably receiving and guiding the punch body during the movement that forges the axle spindle. A lubrication passage in the punch supplies a lubricant between the punch body work surface and the mandrel.

8 Claims, 8 Drawing Figures

AXLE SPINDLE FORMING APPARATUS

This is a division of application Ser. No. 773,456, filed Mar. 2, 1977, now U.S. Pat. No. 4,100,781.

BACKGROUND OF THE INVENTION

1. Field of the Invention

The present invention relates to an improved apparatus and method for forming an axle spindle on a hollow axle blank.

2. Description of the Prior Art

Spindles are formed on the ends of axle blanks in order to mount associated wheels, usually by anti-friction bearings that minimize friction during wheel rotation. Axle blanks on which the spindles are formed usually have a hollow configuration of a round tubular shape whose diameter must be decreased at its end or ends in order to provide various reduced diameter portions, axial ridges, and tapered frustoconical surfaces that define the axle spindle. A conventional method for forming such axle spindles is by hot forging at three work stations. Each work station incorporates a pair of split dies used in the forging. At the first station, the split dies grip the blank about its heated end and an axial upsetter is utilized to form the blank material to conform with the interior of the split dies. A hammer operation is performed at the second station by the split dies thereof, one die being mounted stationary with the heated blank supported thereby, and the other die being movably supported to pound the blank between the dies. Another axial upsetter is utilized at the third station to shape and size the blank between the split dies of this station.

Rough axle forgings made by the split die process described above must be machined in order to complete the spindle forming process. This machining usually requires a first semi-rough cut prior to a semi-finish cut that proceeds a finishing step during which the spindle is polished. Prior to the material removal during these machining steps, a parting flash that is caused by the split die construction must first be removed from the forged spindle as well as scale that builds up during the forging process. Care must be taken during this forging process to prevent internal voids from occurring in the forged axle spindle and to make sure that the inner and outer axle spindle surfaces are concentric with each other. Rotation of the axle blank between each pound at the second work station must be limited in order to prevent the internal voids from forming.

Axle spindle forming, forging and other forming, etc. are shown by U.S. Pat. Nos.: 2,053,975, 2,165,472, 3,165,199, 3,327,513, 3,465,418, 3,580,038, 3,668,918 and 3,673,888.

SUMMARY OF THE INVENTION

An object of the present invention is to provide an improved apparatus and method for forming an axle spindle from a hollow axle blank. Advantages resulting from the axle spindle forming apparatus and method are tighter tolerance of the forged spindle so that subsequent machining requirements are reduced, elimination of parting flash present with the split die type of forging, concentricity of the inner and outer axle spindle surfaces formed on the axle blank, reduction of the tendency to form internal voids, and easy removal of scale that is formed on the axle spindle by heating during forging of the spindle as it is formed.

In carrying out the above object and other objects of the invention in order to obtain the advantages resulting therefrom, the axle spindle forming apparatus and method incorporate a hollow punch including a metallic body with an inner work surface and a mandrel fixed within a work opening of the punch body defined by its work opening. The mandrel projects from a closed end of the punch body toward an open end defined by the work surface in a spaced relationship to this surface. During forming of an axle spindle on a hollow axle blank, the punch is moved relative to the axle blank along the direction the mandrel projects so that the mandrel is received within the axle blank as the punch work surface forms a spindle about the mandrel. Since the hollow punch body completely surrounds the axle blank as the spindle is formed thereon, no parting flash is present on the formed spindle unlike axle spindles which are formed by split die type of forging operations. Likewise, the construction of the punch with its mandrel fixed within the hollow body provides concentricity of the inner and outer axle spindle surfaces formed by the punch.

Several of the hollow punches are preferably utilized to form the axle spindle in progressive steps. The metallic body of each punch has an elongated annular shape whose inner extremity provides the work surface that defines the work opening for receiving the axle blank during forming of the spindle. The mandrel of each punch also has an elongated shape with one end fixedly mounted at the closed end of the punch body and another tapered end located adjacent the open end of the body. Between its two ends, the elongated mandrel has a round outer surface about which the spindle is formed. Certain of the punches have annular work surface portions that are oriented in an axial direction with respect to the direction the mandrel projects so as to engage the axle blank in an endwise manner during the forming. All of the punches but the first one to initially form the axle blank have a smaller diameter work surface portion adjacent the closed end of the punch body than adjacent the open end.

Formation of the axle spindle preferably begins by heating the axle blank end to a hot forging temperature and then positioning the blank in a stationary manner so that the punch can be moved relative thereto to forge the axle spindle as the mandrel is received within the end of the axle blank with the punch body work surface forging the axle blank about the mandrel. A pair of cooperable gripper dies including gripping portions are preferably utilized to position the axle blank and define an elongated opening with a round cross section for slidably receiving and guiding the punch body during the punch movement that forges the axle spindle. The punch body has a sufficient length so its work surface extends past the heated portion of the axle blank end to the unheated portion before deformation occurs. A lubrication passage in the punch may be provided for introducing lubricant into the punch body work opening between its work surface and the outer surface of the mandrel. An undercut on the mandrel at a work station where considerable outward movement of the blank material takes place facilitates punch withdrawal.

In addition to eliminating parting flash present with the split die type of axle spindle forging and maintaining the concentricity of the inner and outer axle spindle surface, the apparatus and forging method of the invention have been found to provide tighter tolerance to the forged spindle so that subsequent machining requirements are reduced. Likewise, it has been found that there is a decreased tendency to form voids in the axle material during forming the spindle and that any scale which may be formed on the spindle can be removed much easier than with previous forging processes.

The objects, features and advantages of the present invention are readily apparent from the following detailed description of the preferred embodiment taken in connection with the accompanying drawings.

DETAILED DESCRIPTION OF THE PREFERRED EMBODIMENT

Figure 1:
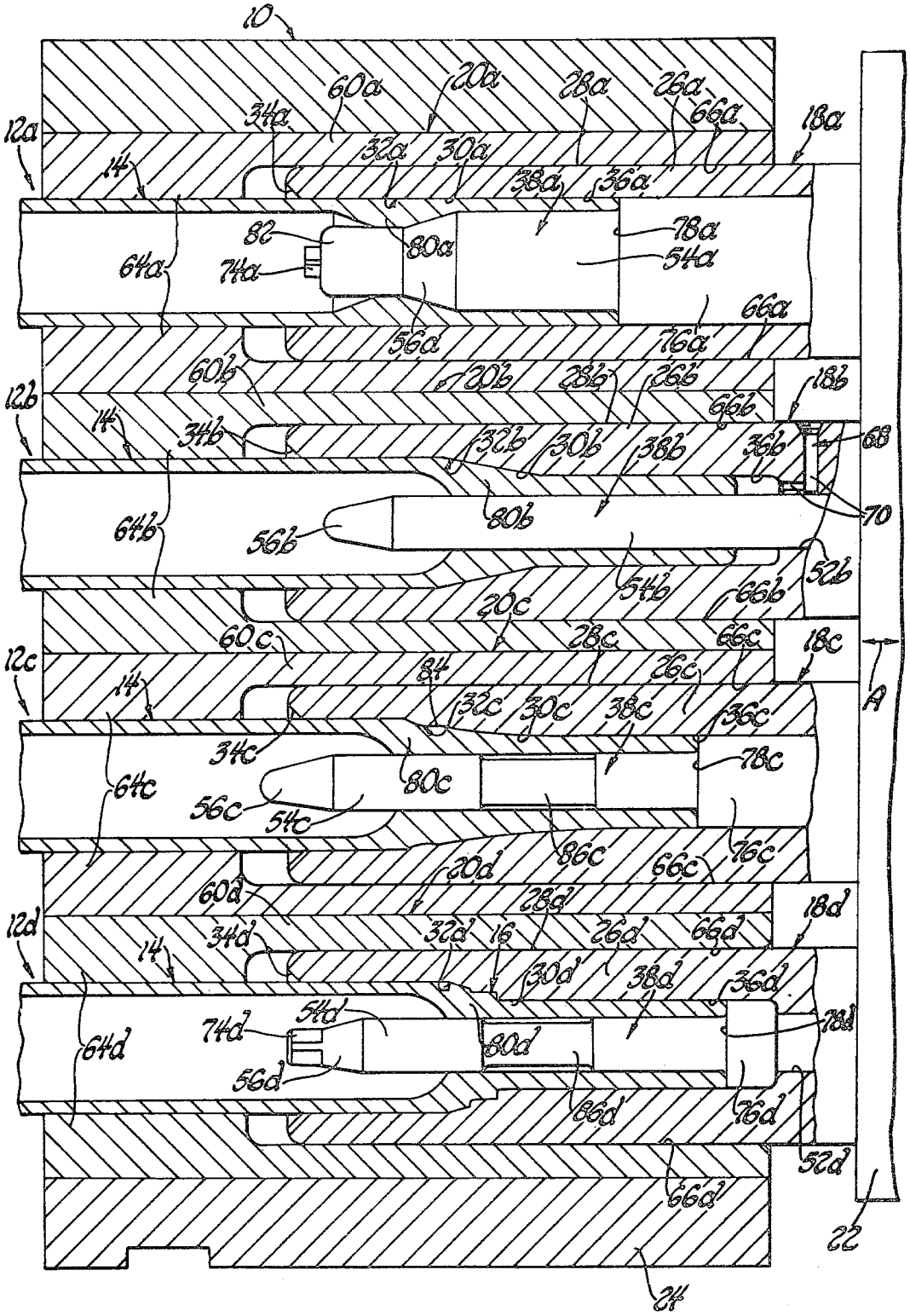
FIG. 1 is a sectional view through axle spindle forming apparatus constructed according to the invention and utilized according to the method thereof to form axle spindles on hollow axle blanks.
Figures 2, 3, 4:
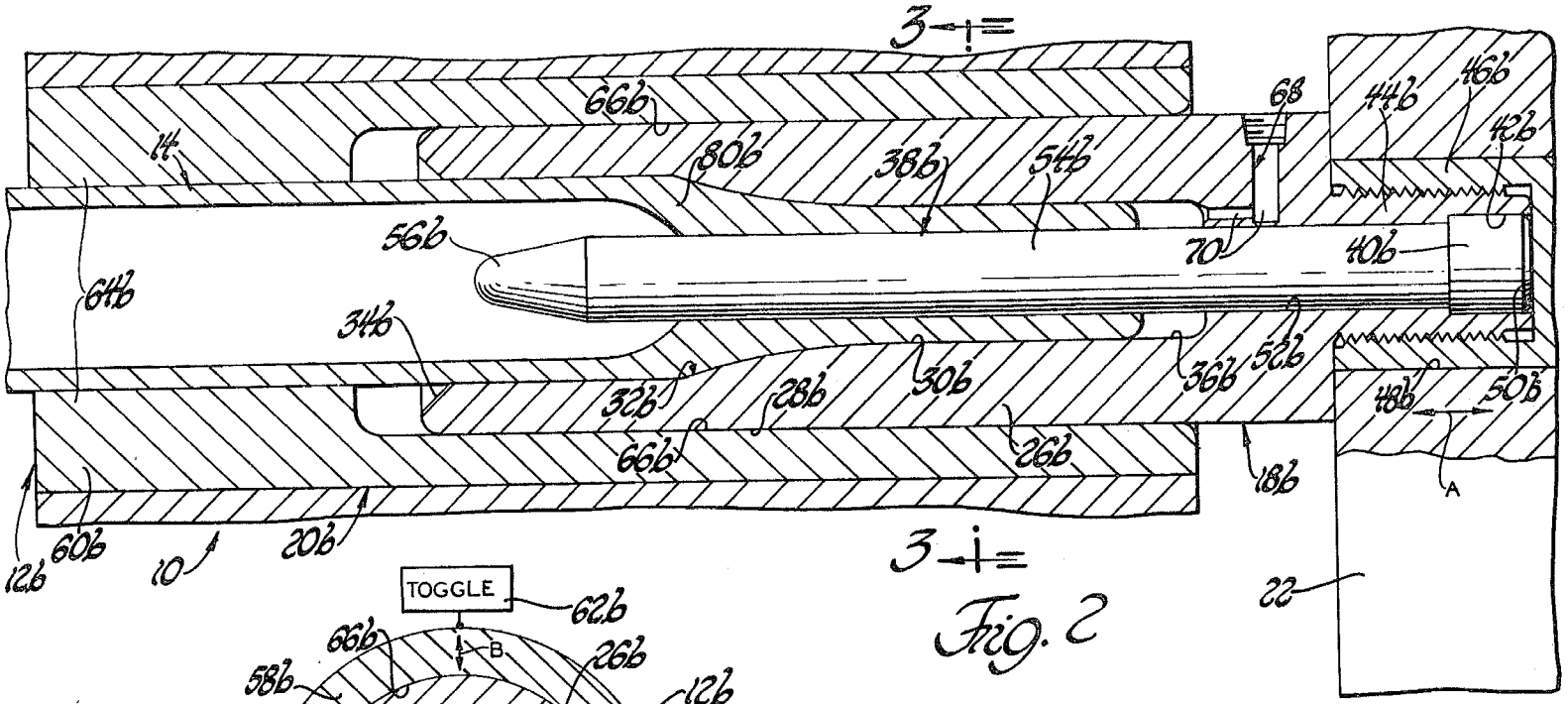
FIG. 2 is an enlarged view of a portion of FIG. 1.
FIG. 3 is a sectional view taken along line 3—3 of FIG. 2.
FIG. 4 is a perspective view of the type of axle blank that can be formed by the apparatus and method of the invention to include an axle spindle.

Referring to FIG. 1, apparatus that embodies the present invention and is used in accordance with the method thereof is collectively indicated by reference numeral 10 and includes four work stations **12*a*, 12*b*, 12*c* and 12*d*. Hollow axle blanks 14, FIG. 4, are indexed through the work stations 12*a*, 12*b*, 12*c* and 12*d* shown in FIG. 1 either manually or by a suitable conveyor mechanism so as to be formed thereby to include an axle spindle 16, FIG. 7, that is ready for a light finishing machining cut or polishing operation. Each work station includes a hollow punch 18*a*, 18*b*, 18*c* and 18*d* and cooperable axle blank grippers 20*a*, 20*b*, 20*c* and 20*d* used to form the axle spindles by a hot forging process. The punches 18*a*, 18*b*, 18*c* and 18*d* are mounted on a ram 22 that is power actuated to move to the left and to the right as shown by arrow A while the grippers 20*a*, 20*b*, 20*c* and 20*d* are mounted on a stationary support 24 so as to hold the axle blanks 14** against movement.

Figure 5:
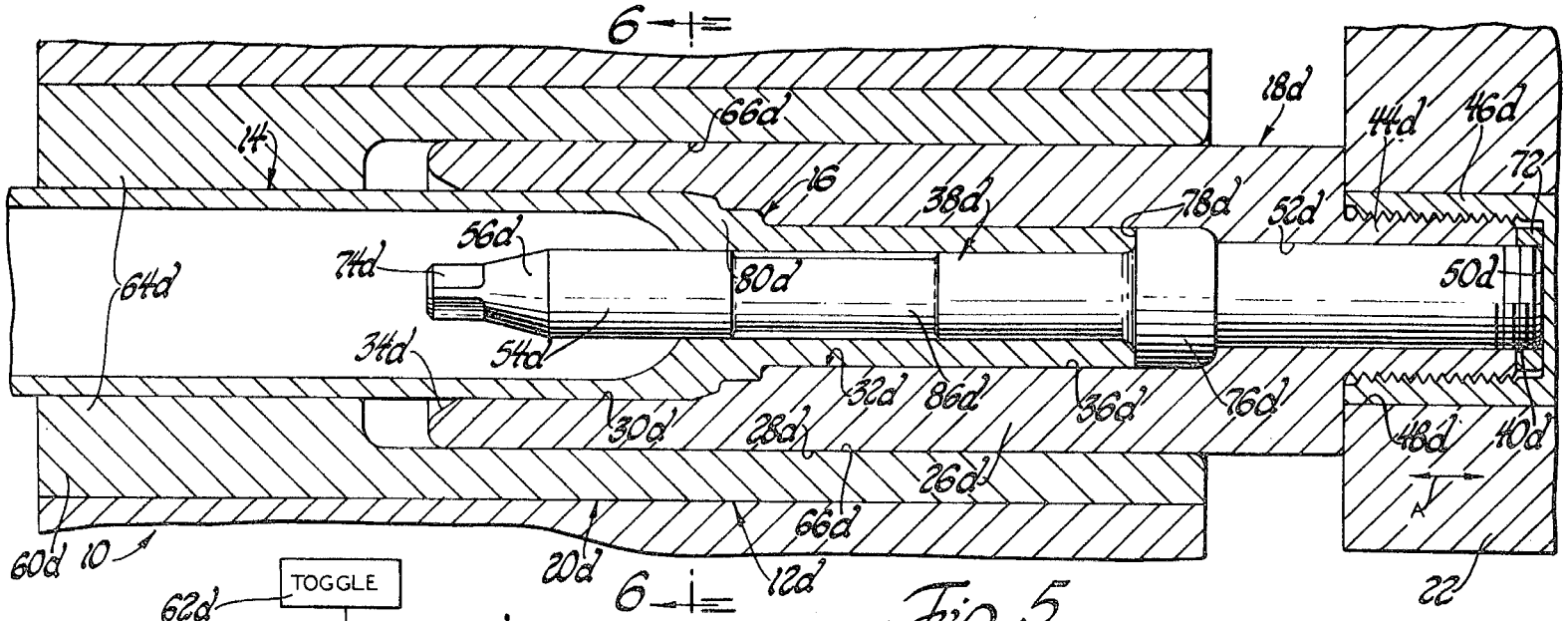
FIG. 5 is an enlarged view of another portion of FIG. 1.
Figure 8:
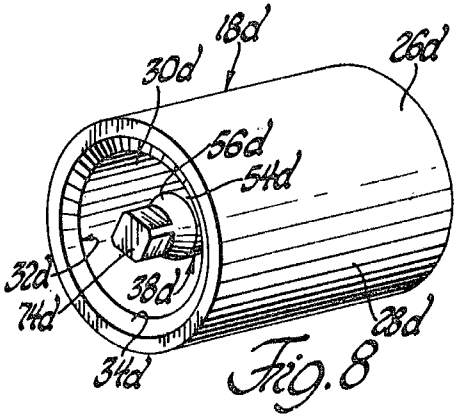
FIG. 8 is a partial perspective view of a hollow punch of the apparatus shown in FIGS. 4 and 6.
Figure 6:
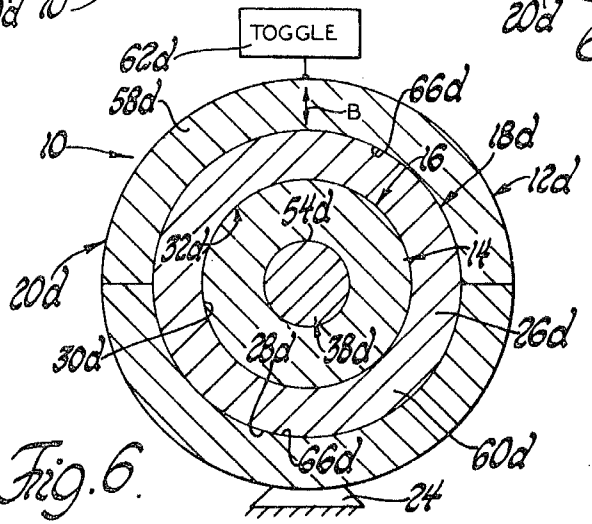
FIG. 6 is a sectional view taken along line 6—6 of FIG. 5.

The punch **18*b* and its cooperable gripper 20*b* of work station 12*b* are further illustrated in FIGS. 2 and 3 while the punch 18*d* and its cooperable gripper 20*d* of work station 12*d* are further illustrated in FIGS. 5, 6 and 8. It is understood that the description and drawings regarding these further illustrated work stations 12*b* and 12*d* are also applicable to the work stations 12*a* and 12*c***, like reference numerals with the appropriate letter subscripts being used to identify like components and portions thereof of each work station.

With reference to FIGS. 2 and 3, the hollow punch **18*b* of work station 12*b* includes a metallic body 26*b* which has an elongated annular shape. A round outer surface 28*b* of the punch body 26*b* and a round inner work surface 30*b* cooperate to provide the annular punch body shape. Inner work surface 30*b* defines a work opening generally indicated by numeral 32*b* and having a first open end 34*b* as well as a closed second end 36*b*. A mandrel 38*b* of punch 18*b* is received within the punch body work opening 32*b* projecting from its closed end 36*b* toward its open end 34*b*. A first enlarged mandrel end 40*b* is fixed within a socket 42*b* of a threaded punch body end portion 44*b*. A threaded insert 46*b* press fitted into an opening 48*b* of the reciprocating ram 22 threadedly receives the punch body end portion 44*b* so that both the body end portion and the enlarged mandrel end 40*b* engage a wall 50*b* of the insert so as to fix both the punch and the mandrel to the ram. From its enlarged end 40*b*, mandrel 38*b* projects through a round hole 52*b* in the closed end of the punch body and has a round outer surface 54*b* extending to a second tapered mandrel end 56*b*. The mandrel surface 54*b* is located in a spaced relationship to the punch body work surface 30*b* so that the work opening 32*b*** has an annular shape.

With particular reference to FIG. 3, the axle blank gripper **20*b* includes a pair of cooperable upper and lower gripper dies 58*b* and 60*b* that define an annular shape in the clamping position shown in FIG. 3. An overcenter toggle 62*b* mounts the upper die 58*b* for vertical movement between an upper nonclamping position and the lower clamping position where semi-circular die gripping portions 64, FIG. 2, cooperate to clamp the axle blank 14. To the right of its gripping portion 64 as viewed in FIG. 2, the upper and lower gripping dies 58*b* and 60*b* include semi-circular guide surfaces 66*b* that define an elongated guide opening of a round cross section for slidably receiving and guiding the metallic punch body 26*b* as the punch 18*b* is moved to the left by ram 22**.

During the forging process, an axle blank 14 is heated to a hot forging temperature of about 2100° F. or so and after first being forged at the work station **12*a* in a manner subsequently described, the axle blank is positioned and clamped by the gripper 20*b* shown in FIGS. 2 and 3 ready for forging by the hollow punch 18*b*. Ram 22 is then actuated to move from the right toward the left to the position shown. During this movement toward the left, the outer end of punch body 26*b* is first received within the guide opening defined by the guide surfaces 66*b* of the upper and lower gripper dies 58*b* and 60*b*. The larger diameter open end 34*b* of punch body 26*b* slidably receives the end of axle blank 14 as the punch movement to the left proceeds at a conventional fast rate used in forging, the end of the axle blank then initially having the same diameter as the rest of the blank as shown at work station 12*a* in FIG. 1. As punch 18*b* proceeds moving toward the left, the work surface 30*b* impacts with the axle blanks 14 and begins to form it about the outer surface 54*b* of mandrel 38*b* to the shape shown in FIG. 2. The length of punch body 26*b* is sufficiently long so that it extends past the red hot heated portion of the axle blank to its unheated portion before the impact and consequent material movement takes place. One impact with punch 18*b* completes the forging at work station 12*b*** and the axle blank is then ready for indexing to the next work station.

As the forging proceeds in the manner described above, the hollow punch body **26*b* completely surrounds the axle blank 14 in a continuous manner so that its end being forged does not have any parting flash like that present during forging with conventional split dies. Likewise, the concentricity of the inner and outer axle spindle surfaces being formed can be maintained due to the fixed relationship of the mandrel 38*b* within the punch body 26b. It has also been found that there is a lessened tendency of the forging material to form internal voids than is the case with the more conventional split die type of forging and that any scale which is formed on the axle blank can much more easily be removed. With regard to the scale formed during the forging, it should be noted that the metallic body 26b of punch 18b includes a lubrication passage 68 cooperatively defined by a pair of perpendicular bores 70 so that a lubricant can be introduced into the punch between its work surface 30b and mandrel 38b prior to the forging. The lubricant may be an oil that is atomized and blown in with air so that the air removes any scale that may be present on the work surface or the mandrel while the oil adheres thereto ready to provide lubrication during the subsequent forging. It is also possible to flood the punch with a liquid oil lubricant that provides cooling as well as lubrication. Lubrication in either manner is particularly helpful at the work station 12b because there is a considerable amount of inward material movement as the axle blank 14 is forged at this work station. In this regard, it should also be noted that the closed end 36b of the punch body work opening 32b is axially spaced from the end of the axle blank 14** in the fully inserted punch position so that the material can flow axially without restraint and thereby accommodate for variances in the blank wall thickness. Also, the other punches likewise include similar lubrication passages although this is not shown in the drawings.

Figure 7:
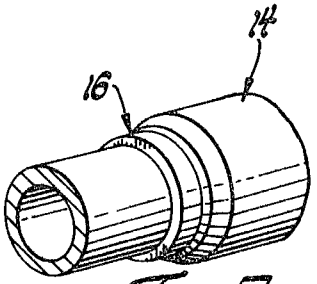
FIG. 7 is a perspective view of a completed axis spindle that is formed by the apparatus of the invention from the type of axle blank shown in FIG. 4.

With reference to FIGS. 5 through 8, the axle blank 14 is forged to a semi-finished condition shown in FIG. 7 by the hollow punch 18d of work station 12d and its cooperable gripper 20d. Except for the configuration of its punch body work surface 30d and a few other modifications, the construction of hollow punch 18d is the same as the punch 18b previously described in connection with FIGS. 2 and 3 and the description thereof is thus applicable to the structure of work station 12d so as not to necessitate repetition of this description. The work opening 32d defined by the work surface 30d has a shape that is conjugate to the shape of the final axle spindle 16 being forged. This axle spindle after forging at work station 12d is in a semi-finished condition ready for a light machining cut or other finishing operation prior to use. It is possible to achieve the tolerances necessary to decrease the material removal due to the hollow punch construction with the internal mandrel about which the spindle is formed by the cooperable work surface. Likewise, as previously noted, the concentricity of the inner and outer spindle surfaces are maintained accurately, parting flash present with split die type of forging is eliminated, the tendency to have internal voids formed during the forging is reduced, and any scale that may be formed on the spindle is much more easily removed.

As seen by particular reference to FIG. 5, the mandrel 38d has a somewhat different configuration than the mandrel 38b shown in FIG. 2. This mandrel 38d is inserted through the round punch body hole 52d at the work opening closed end 36d from the left toward the right rather than from the right toward the left as with the mandrel 38b shown in FIG. 2. End portion 40d of mandrel 38d is threaded into a nut 72 that axially seats against the punch body end portion 44d as well as with the insert wall 50d. At its left-hand tapered end 56d, mandrel 38d has a squared portion 74d that can be held by a wrench during tightening of nut 72. As the nut 72 is tightened, an enlarged diameter intermediate mandrel portion 76d is pulled into engagement with the punch body about the left-hand end of hole 52d so as to secure the mandrel in place. Tightening of the threaded punch body end portion 44d within the threaded insert 46d is also achieved by applying a wrench to the squared mandrel end portion 74d. An annular work surface portion 78d of mandrel portion 76d is oriented in an axial direction and engages the end of axle blank 14 during forging of the spindle 16 to ensure precise formation of the spindle end.

Intermediate its ends, the mandrel 38d shown in FIG. 5 includes an undercut 86d that facilitates withdrawal of the punch 18d after its impact with the heated axle blank. This undercut construction is particularly helpful at work stations where there is outward material movement, i.e. work station 12c as well as work station 12d.

With reference to FIG. 1, forging of the axle spindle begins at work station 12a as a heated tubular axle blank 14 is clamped by the gripper 20a. Work surface 30a of hollow punch 18a at this station has a uniform diameter and its axially oriented annular work surface portion 78a of mandrel 38a impacts the mandrel endwise to forge a thickened wall portion 80a that extends inwardly about a blunt end nose 82 of the tapered mandrel end portion 56a. The mandrel surface 54a may also have a slight inward taper toward the left depending on the particular configuration of the axle to be formed. As previously described, the hollow punch 18b at work station 12b forms the mandrel end portion to the right of thickened wall portion 80b inwardly about the mandrel 38b so as to have a reduced diameter shape that tapers outwardly toward the left. Subsequently, at work station 12c, the axially oriented annular work surface portion 78c impacts the mandrel end so that the work surface 30c can forge an annular ridge 84 that begins outward material movement for forming the final axle spindle shape to be forged. At the final work station 12d, the semi-finished axle spindle is forged in the manner previously described to complete the forging process.

In summary, many advantages are achieved by the spindle forming apparatus and method of the invention, namely; the tighter tolerance so that subsequent machining requirements are reduced, elimination of parting flash present with conventional split die forged spindles, concentricity of the inner and outer axle spindle surfaces formed, reduction of the tendency to form internal voids in the axle spindle material, and easy removal of scale caused by heating of the axle as it is formed by hot forging.

Of course, the relative movement between the axle blanks 14 and the punches 18a, 18b, 18c and 18d can be achieved by mounting the axle blanks on a movable ram and holding the punches stationary. However, moving the punches and holding the axle blanks stationary, as disclosed, is a more preferred way of forging the spindles. Likewise, although the advantages achieved are best obtained by use of the preferred apparatus and method disclosed, other apparatus and methods of using the same are possible for practicing the present invention as defined by the following claims.

What is claimed is:

1. Apparatus for forming a round axle spindle comprising a hollow punch including a metallic body having an annular work surface defining a round work opening with a first open end for receiving a hollow axle blank to be formed and a second closed end, and an elongated central mandrel fixed within the punch body work opening projecting toward the first end thereof and from the second end thereof and having a round outer surface that is coaxial with and in an spaced relationship to the work surface defining the opening such that the axle blank is formed by the work surface about the mandrel for a greater distance than the spacing between the punch work surface and the mandrel so as to thereby provide a round spindle during relative movement between the punch and the axle blank along the direction the mandrel projects.

2. Apparatus for forming a round axle spindle comprising a hollow punch including an elongated metallic body of an annular shape having an inner work surface defining a round work opening with a first open end for receiving a hollow axle blank to be formed and a second closed end, and an elongated mandrel fixedly mounted on the punch body centrally within the work opening thereof projecting toward the first work opening end from the second end thereof and having a round outer surface that is coaxial with and in a spaced relationship to the work surface defining the opening such that the axle blank is formed by the work surface about the mandrel for a greater distance than the spacing between the punch work surface and the mandrel so as to thereby provide a round spindle during relative movement between the punch and the axle blank along the direction the mandrel projects.

3. Apparatus as claimed in claim 2 wherein the punch includes a work surface portion of an annular shape located at the closed end of the work opening and oriented axially with respect to the direction the mandrel projects so as to engage the axle blank during the forming.

4. Apparatus as claimed in claim 2 wherein the closed end of the work opening has a smaller diameter than the open end thereof.

5. Apparatus for forging an axle spindle comprising a hollow punch including an elongated metallic body of an annular shape having an inner work surface defining a round work opening with a first open end for receiving a hollow axle blank to be forged and a second closed end, an elongated mandrel received within the work opening of the punch body, said mandrel having a first tapered end and a second end fixedly mounted on the punch body adjacent the closed end of the work opening such that the mandrel projects centrally through the opening in a spaced relationship to the work surface toward the open end of the work opening, the mandrel having a round outer surface between the ends thereof and being coaxial and in a spaced relationship to the work surface defining the opening such that the axle blank is forged by the work surface about the mandrel for a greater distance than the spacing between the punch work surface and the mandrel so as to thereby provide a round spindle during relative movement between the punch and the axle blank along the direction the mandrel projects, and a lubrication passage for introducing lubricant into the work opening.

6. Apparatus for hot forging a round axle spindle comprising a hollow punch including an elongated metallic body of an annular shape having an inner work surface defining a round work opening with a first open end for receiving a heated hollow axle blank to be forged and a second closed end, an elongated mandrel received within the work opening of the punch body, said mandrel having a first tapered end and a second end fixedly mounted on the punch body adjacent the closed end of the work opening such that the mandrel projects centrally through the opening toward the open end of the work opening, the mandrel having a round outer surface extending between the ends thereof in a coaxial and spaced relationship to the work surface defining the opening such that the axle blank is forged by the work surface about the mandrel for a greater distance than the spacing between the punch work surface and the mandrel so as to thereby provide a round spindle during relative movement between the punch and the axle blank along the direction the mandrel projects, and a pair of cooperable gripper dies including gripping portions for locating the axle blank during the forging and defining an elongated opening with a round cross section for slidably receiving and guiding the punch body during the movement that forges the axle spindle.

7. Apparatus as claimed in claim 6 wherein the annular punch body has a sufficient length between its ends so that its open end receives an unheated portion of the axle blank before the work surface thereof forms the heated axle blank.

8. Apparatus as claimed in claim 6 wherein the mandrel includes an undercut that facilitates withdrawal of the punch from the forged axle blank.

* * * * *